US006148447A

United States Patent [19]

Bain et al.

[11] Patent Number: 6,148,447

[45] Date of Patent: Nov. 21, 2000

[54] REINFORCED PROTECTIVE SUIT FOR OPERATORS OF SNOWMOBILES, MOTORCYCLES, AND THE LIKE

[76] Inventors: Dylan M. Bain; Michael J. Bain, both of 8500 - 43rd Ave., Kenosha, Wis. 53142

[21] Appl. No.: 09/159,723

[22] Filed: Sep. 24, 1998

[51] Int. Cl.[7] ..... A41D 13/12; A62B 17/00; G21F 3/02

[52] U.S. Cl. ..... 2/456

[58] Field of Search ..... 2/456, 463, 464, 2/465, 467, 2.5, 44, 455, 2.15, 2.16, 2.17, 69, 69.5

[56] References Cited

U.S. PATENT DOCUMENTS

| | | | |
|---|---|---|---|
| 2,338,535 | 1/1944 | Pfleumer | 9/20 |
| 3,398,406 | 8/1968 | Waterbury | 2/2.5 |
| 4,100,620 | 7/1978 | Pecoraro | 2/102 |
| 4,639,944 | 2/1987 | Lashley et al. | 2/2 |
| 5,013,271 | 5/1991 | Bartlett | 441/65 |
| 5,052,052 | 10/1991 | Gilford et al. | 2/2 |
| 5,337,418 | 8/1994 | Kato et al. | 2/2 |

*Primary Examiner*—John J. Calvert
*Assistant Examiner*—Shirra L. Jenkins
*Attorney, Agent, or Firm*—Jansson, Shupe, Bridge & Munger Ltd.

[57] ABSTRACT

A protective suit is provided for a snowmobile rider. The protective suit includes a torso portion having a front and a back. A first set of protective plates is disposed in the front of the torso portion. The protective plates of the first set of the protective plates are positioned adjacent to one another to form a flexible shield in the front of the protective suit. Similarly, a second set of protective plates is disposed in the back of the torso portion. The protective plates of the second set of protective plates are positioned adjacent to one another to form a second flexible shield in the back of the protective suit.

5 Claims, 7 Drawing Sheets

FIG. 8
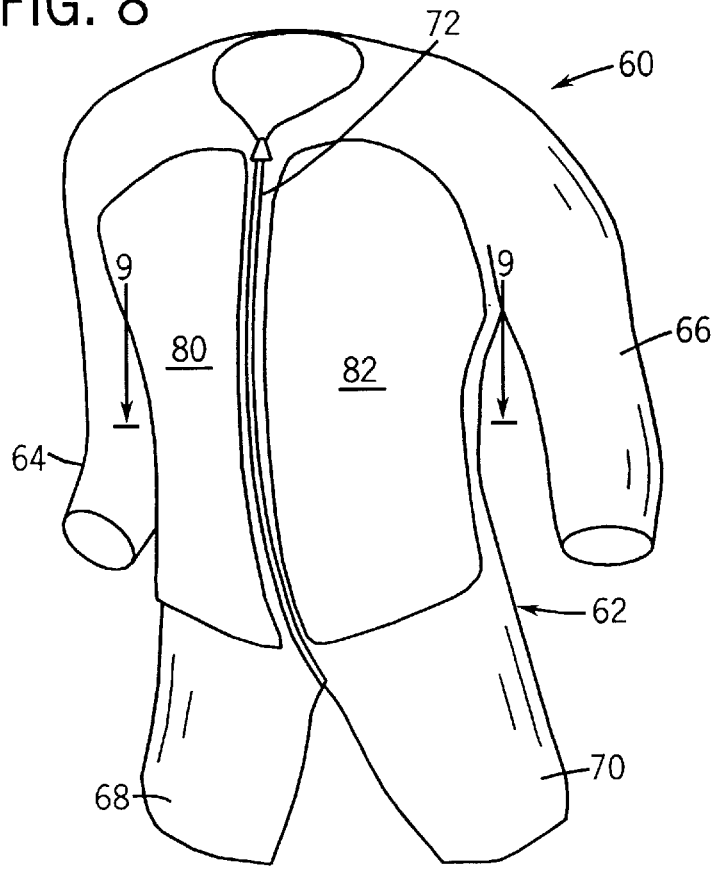
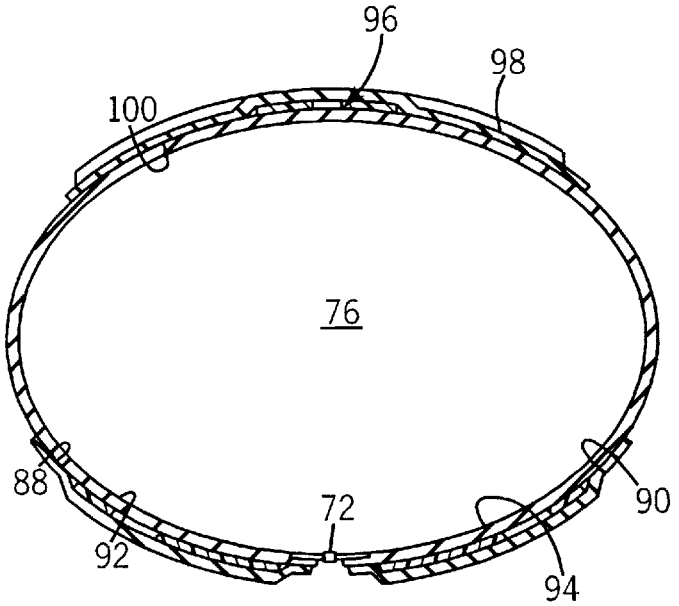
FIG. 9

REINFORCED PROTECTIVE SUIT FOR OPERATORS OF SNOWMOBILES, MOTORCYCLES, AND THE LIKE

BACKGROUND OF THE INVENTION

This invention relates to snowmobile apparel, and in particular, to a protective suit for protecting a rider from trauma, as well as from the elements, during use of a snowmobile.

Accidents pose a significant risk to the riders of snowmobiles. Since a snowmobile provides little structural protection to a rider for those potential dangers which are external to the vehicle, snowmobile accidents tend to cause significant injuries to the rider. These dangers include the risk of trauma associated with a rider falling from the snowmobile or with a rider striking an object in the snowmobile's path.

Further, a significant number of accidents with snowmobiles involve water. Since snowmobiling is a cold weather activity, the risk of hypothermia is great for a rider who accidentally falls through ice formed on a lake or river. As a result, it is highly desirable to provide a snowmobile suit which protects a wearer against hypothermia, as well as, protecting the wearer against potential trauma to which the rider is susceptible during accidents.

Therefore, it is a primary object and feature of the present invention to provide a protective suit for a snowmobile rider which protects a wearer against hypothermia.

It is a further object and feature of the present invention to provide a protective suit for a snowmobile rider which protects a wearer against potential trauma to which the wearer is susceptible during accidents.

If is a further object and feature of the present invention to provide a protective suit for a snowmobile rider which is lightweight, flexible, and aesthetically pleasing.

It is a further object and feature of the present invention to provide a protective suit for a snowmobile rider which is simple to manufacture.

In accordance with the present invention, a protective suit is provided for a snowmobile rider. The protective suit includes a first inner layer and a second outer layer affixed to the inner layer. A set of protective plates is disposed between the inner and outer layers. The protective plates are arranged adjacent to one another to form a flexible protective shield within the suit.

It is contemplated that the first and second layers be constructed from a buoyant material. In addition, it is contemplated to construct the first and second layers from a heat retaining material.

One or more of the protective plates of the set of protective plates may be generally circular in shape. An adhesive is disposed between adjacent protective plates. A second set of protective plates may also be disposed between the inner and outer layers. Each of the protective plates of the second set of protective plates are arranged adjacent to one another for form a second flexible protective shield within the suit.

In accordance with a further aspect of the present invention, a protective suit for an individual is provided. The protective suit includes a torso portion having a front and a back. A first set of protective plates is disposed in the front of the torso portion. Each of the protective plates of the first set of protective plates is positioned adjacent to one another to form a flexible shield within the protective suit. It is contemplated that one or more of the protective plates of the first set of protective plates be generally circular in shape.

A second set of protective plates may be disposed in the back of the torso portion. Each of the protective plates of the second set of protective plates is positioned adjacent to one another to form a second flexible shield within the suit. It is contemplated that one or more of the protective plates of the second set of protective plates be generally circular in shape.

The front of the torso portion may include a thickened portion. The thickened portion of the torso portion is formed from a buoyant material.

In accordance with a still further aspect of the present invention, a protective suit is provided for a snowmobile rider. The protective suit includes a torso portion having a thickened front and a back. A first set of protective plates is disposed in the front of the torso portion. Each of the first set of protective plates is positioned adjacent one another to form a first flexible shield within the suit. A second set of protective plates is disposed in the back of the torso portion. Each of the second set of protective plates is positioned adjacent one another to form a second flexible shield within the suit. First and second arm receiving portions extend from opposite sides of the torso portion. First and second leg receiving portions also extend from the torso portion. A closure mechanism is provided in the torso portion. The closure mechanism is moveable between a closed position and an opened position.

It is contemplated that one or more of the protective plates in each set of protective plates be generally circular in shape. An adhesive is disposed between adjacent protective plates in the first and second sets of protective plates.

It is contemplated to construct the torso portion from a buoyant material and/or a heat retaining material.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 8 is a perspective view of the third embodiment of the protective suit of the present invention.

FIG. 9 is a cross-sectional view of the protective suit of FIG. 8 taken along line 9—9.

DETAILED DESCRIPTION OF THE PREFERRED EMBODIMENTS

Figure 1:
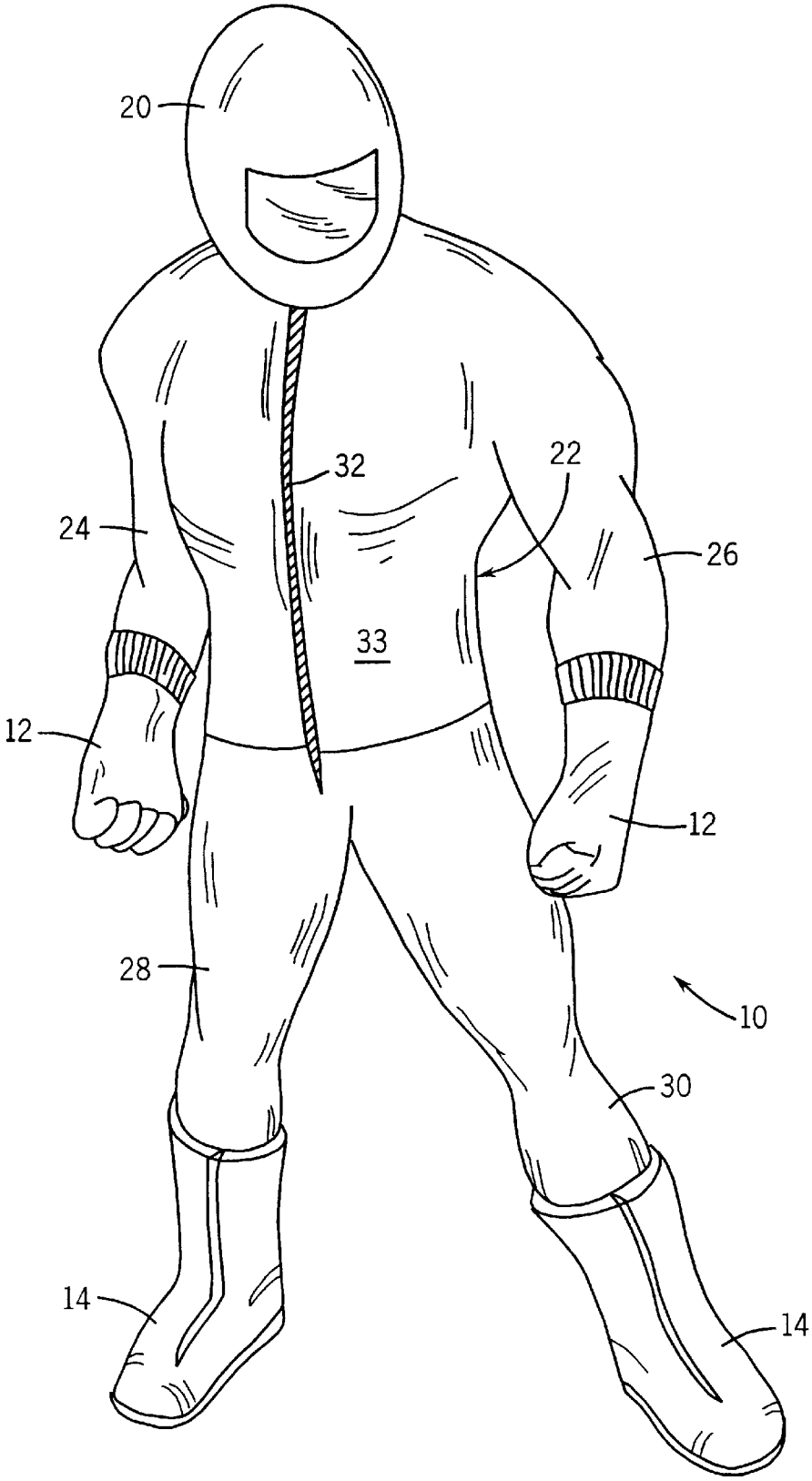
FIG. 1 is an isometric view of a protective suit in accordance with the present invention.

Referring to FIG. 1, a protective suit in accordance with the present invention is generally designated by the reference numeral 10. Protective suit 10 is intended to be worn by a rider of a snowmobile. However, it is contemplated as being within the scope of the present invention for an individual to wear protective suit 10 in conjunction with other activities such as motorcycle or personal watercraft riding, snow boarding, or the like.

Protective suit 10 may be worn with a pair of gloves 12 and a pair of boots 14 in order to further protect the extremities of a wearer of protective suit 10 from the elements. Further, it is contemplated that the wearer of protective suit 10 wear a helmet 20 therewith in order to provide maximum protection for the head of the wearer.

Protective suit 10 includes a torso portion 22 having first and second arm receiving portions 24 and 26, respectively, extending from opposite sides thereof. First and second leg receiving portions 28 and 30, respectively, depend from torso portion 22 and are adapted for receiving the legs of a wearer. It is contemplated that a closure mechanism such as zipper 32 be provided in the front 33 of torso portion 22 of protective suit 10 in order to allow access to the interior thereof and to facilitate the placement of the protective suit 10 on the wearer or the removal of the protective suit 10 from the wearer.

Figure 2:
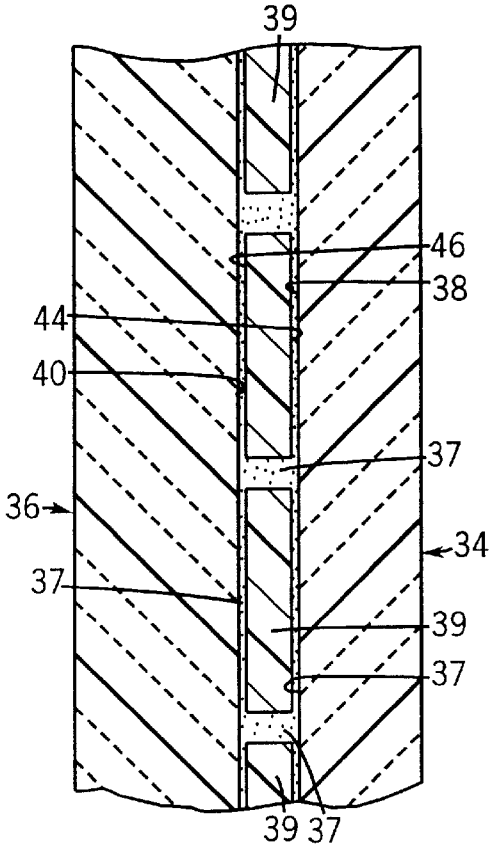
FIG. 2 is a cross-sectional view of a first embodiment of a protective suit in accordance with present invention.

Referring to FIG. 2, in a first embodiment, protective suit 10 includes a first outer layer 34 and second inner layer 36, as hereinafter described. The inner surface 38 of outer layer 34 is affixed to the outer surface 40 of inner layer 36 by a flexible adhesive 37 such as an epoxy or the like. It is contemplated that inner and outer layers 36 and 34, respectively, of protective suit 10 be constructed from an elastomeric material in order to prevent the body heat of the wearer from escaping, thereby keeping the wearer of protective suit 10 warm. Further, the elastomeric material provides a waterproof barrier so as to prevent water from entering the interior of protective suit 10. Finally, since elastomeric materials have a tendency to float, the material of protective suit 10 may facilitate a wearer's ability to swim when wearing the same.

Figure 7:
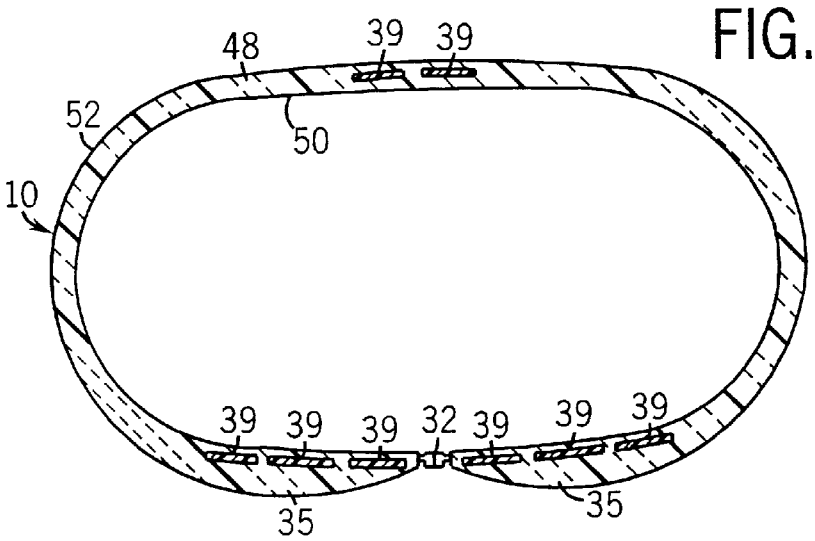
FIG. 7 is a cross-sectional view of the protective suit of the present invention showing the plates disposed therein.
Figure 10:
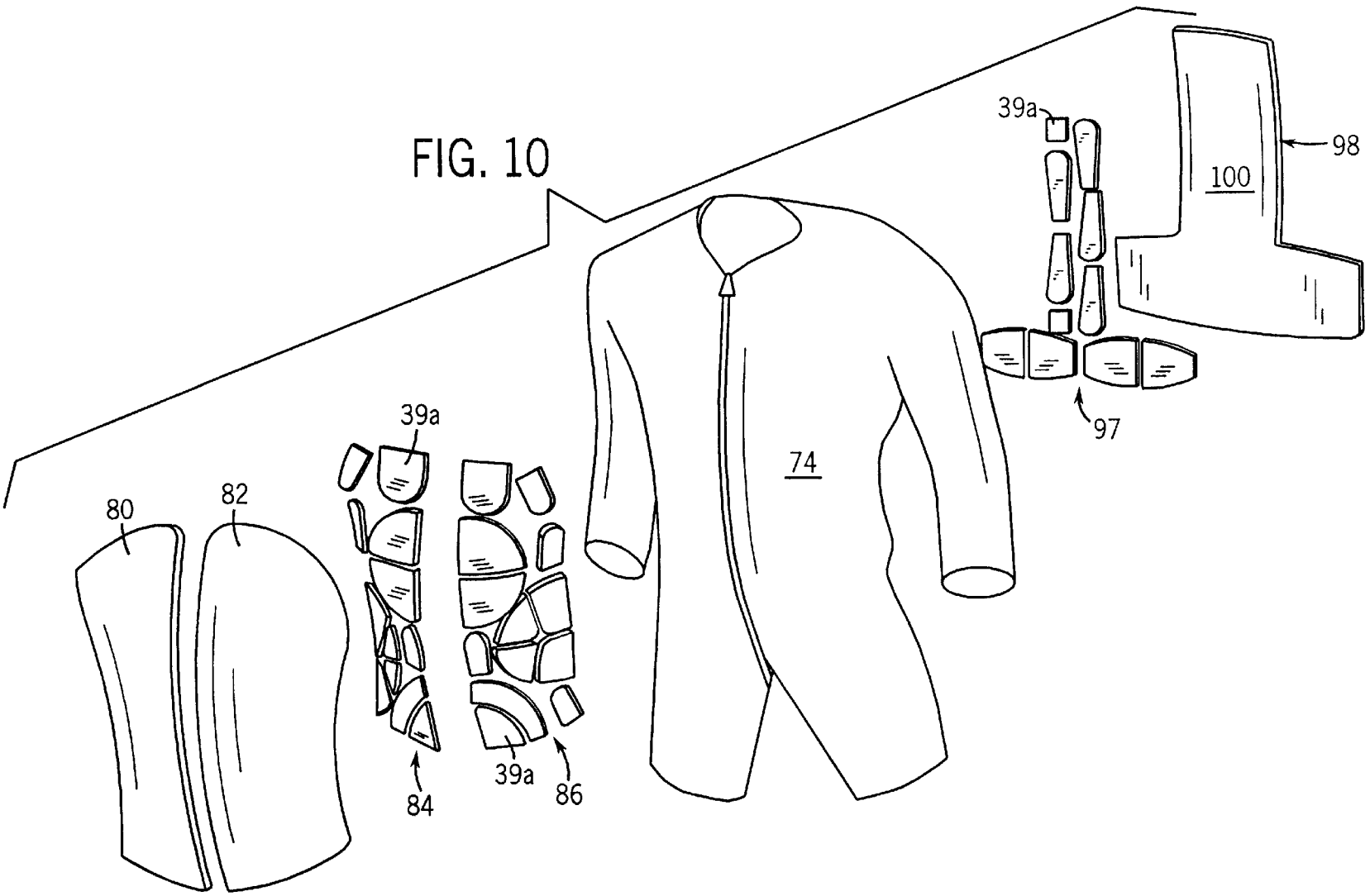
FIG. 10 is an exploded, isometric view showing the third embodiment of the protective suit of the present invention.

Torso portion 22 of protective suit 10 includes front 33 and rear 44. Referring to FIG. 7, torso portion 22 also includes an enlarged chest area 35 which projects from the front 33 thereof. The enlarged chest area 35 is formed from a buoyant material which has a higher propensity to float, and as such, tends to turn the wearer upright in a body of water if the wearer accidently falls therein. In circumstances where the wearer of protective suit 10 is unconscious, the enlarged chest area 35 of protective suit 10 has a tendency to urge a wearer's face out of the water in order to allow the wearer to breathe.

Figure 4:
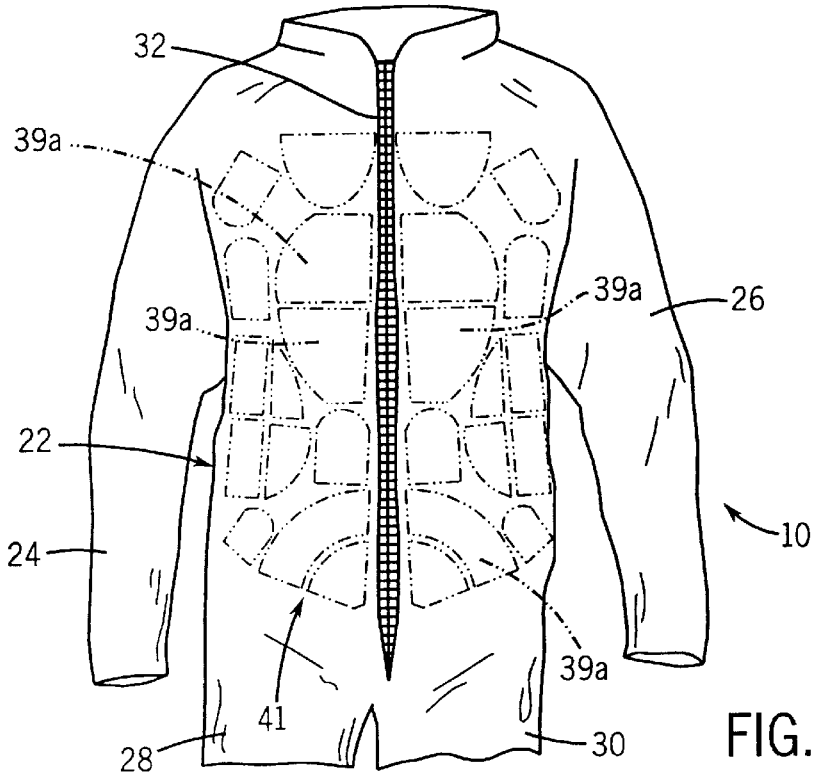
FIG. 4 is front elevational view of a portion of the protective suit in accordance with the present invention showing, in phantom, a first arrangement of front plates disposed in a front portion thereof.
Figure 5:
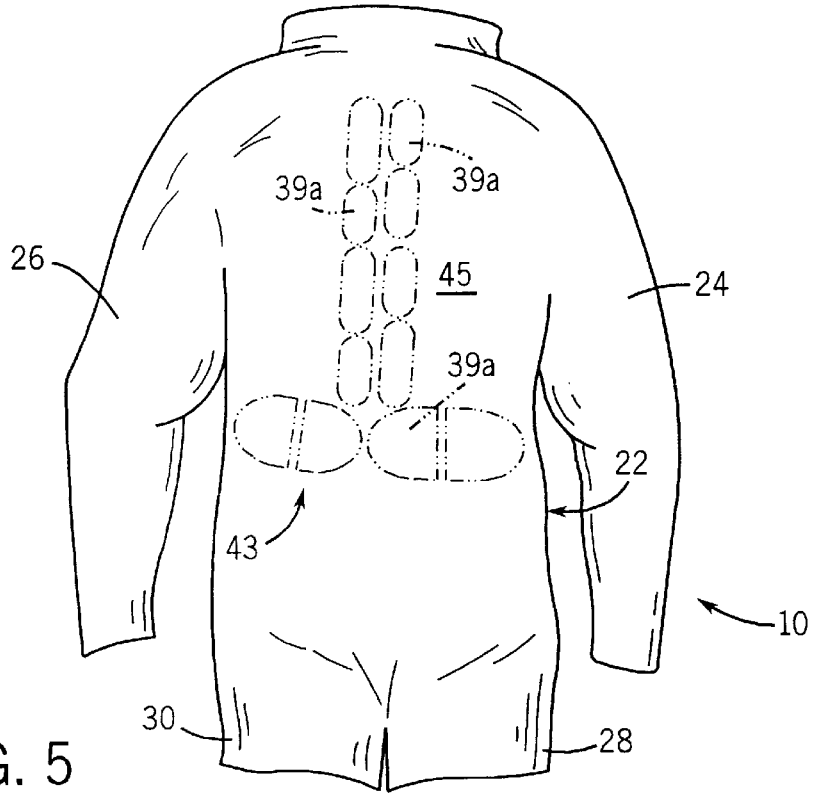
FIG. 5 is a rear elevational view of the position of the protective suit of the present invention showing, in phantom, a first arrangement of rear plates disposed in a rear portion thereof.
Figure 6:
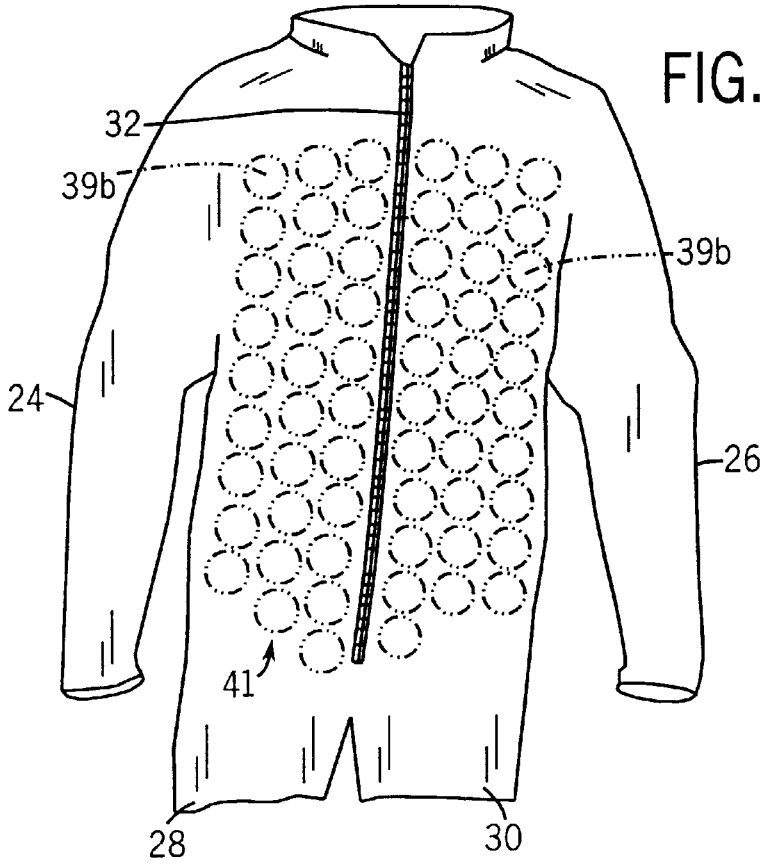
FIG. 6 is a front elevational view of a portion of the protective suit of the present invention showing, in phantom, a second arrangement of front plates disposed in the front portion thereof.

As best seen in FIGS. 4–8 and 10–12, protective plates 39 are positioned within the front 33 and rear 44 of torso portion 22 in order to protect the wearer of protective suit 10 from an external trauma such as a object impacting the protective suit in these areas. In the first embodiment of FIG. 2, protective plates 39 are positioned between the inner surface 38 of outer layer 34 and the outer surface 40 of inner layer 36 to form a flexible shield therebetween. Protective plates 39 are formed from a thermoplastic material in order to dissipate an impact force thereon. As best seen in FIGS. 4 and 6, a front shield 41 is formed by protective plates 39 and is disposed in protective suit 10 to substantially overlap the front torso of the wearer of protective suit 10. Flexible adhesive 37 is disposed between adjacent protective plates 39 to prevent lateral movement of protective plates 39 within protective suit 10 and to simultaneously allow for the flexing of the front 33 of torso portion 22 in the areas between adjacent protective plates 39. Similarly, as best seen in FIG. 5, protective plates 39 may be arranged to form a rear shield 43 in the rear 45 of the torso portion 22 of protective suit 10 so as to substantially overlap the kidneys and the spinal column of a wearer in order to protect these areas of the wearer from trauma.

Referring to FIG. 2, each protective plate 39 is disposed between inner and outer layers 36 and 34, respectively, of protective suit 10 such that the outer surface 44 of each protective plate 39 is affixed to the inner surface 38 of outer layer 34 by flexible adhesive 37. Similarly, the inner surface 46 of each protective plate 39 is affixed to the outer surface 40 of inner layer 36 by flexible adhesive 37 so as to prevent movement of protective plates 39 within protective suit 10.

Figure 3:
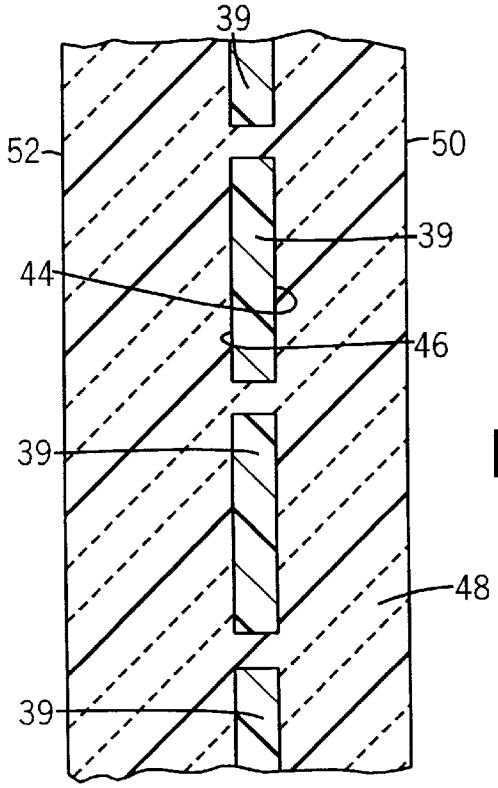
FIG. 3 is a cross-sectional view of a second embodiment of a protective suit in accordance with the present invention.

Referring to FIG. 3, an alternate embodiment is shown wherein protective suit 10 is formed from a single layer 48 of elastomeric material. Protective plates 39 are integrally molded within protective suit 10 so as to form front and rear shields 41 and 43, respectively, as heretofore described. The single layer 48 of elastomeric material of protective suit 10 includes an inner surface 50 which defines the interior of protective suit 10, and an outer surface 52 which defines the exterior of protective suit 10. The elastomeric material of single layer 48 extends in the areas between protective plates 39 so as to prevent lateral movement of protective plates 39 within protective suit 10, and to allow simultaneously for the flexing of the protective suit 10 in those areas in which front and rear shields 41 and 43, respectively, are supported.

Referring to FIGS. 4 and 5, it is contemplated that protective plates **39*a* be constructed of various sizes and shapes in order to maximize the amount of overlap corresponding to various portions of a wearer's body which are susceptible to injury as a result of external trauma, while simultaneously providing the protective suit 10 with sufficient flexibility to allow movement by the wearer thereof. For example, larger protective plates 39*a* may be positioned in protective suit 10** to overlap the kidneys and provide maximum protection to the wearer.

In the alternative, referring to FIG. 6, protective plates 39 may take the form of generally circular plates **39*b* incorporated into protective suit 10 to form the front shield and the rear shield. Circular plates 39*b* maximize the flexibility of the protective suit 10** while simultaneously providing protection against external trauma.

Referring to FIG. 8, a still further embodiment of the protective suit of the present invention is generally designated by the reference numeral 60. Protective suit 60 includes a torso portion 62 having first and second arm receiving portions 64 and 66, respectively, extending from opposite sides thereof. First and second leg receiving portions 68 and 70, respectively, depend from torso portions 62 and are adapted for receiving the legs of a wearer. It is contemplated that a closure mechanism, such as zipper 72, be provided in front 74, FIG. 10, of torso portion 62 of protective suit 60 in order to allow access to the interior 76, FIG. 9, by a wearer.

Figure 11:
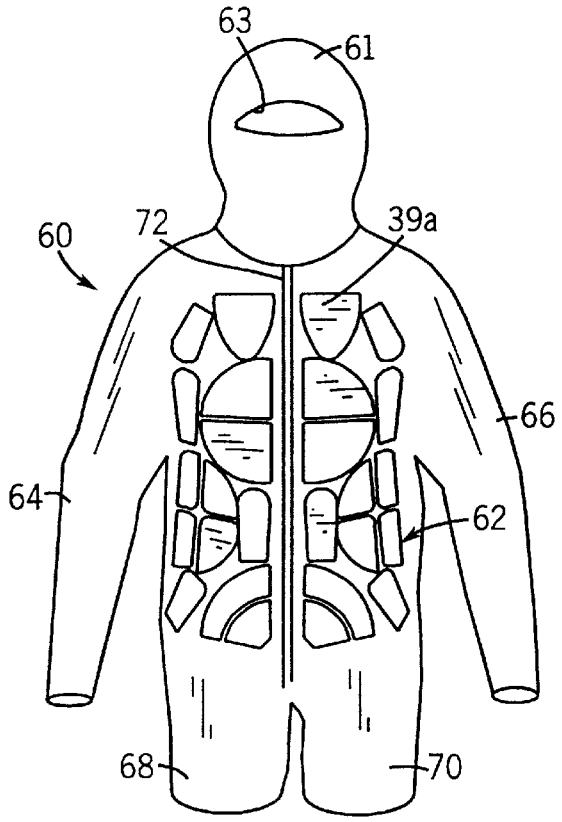
FIG. 11 is a front elevational view of the third embodiment of the protective suit of the present invention showing the first arrangement of front plates disposed in a front portion thereof.
Figure 12:
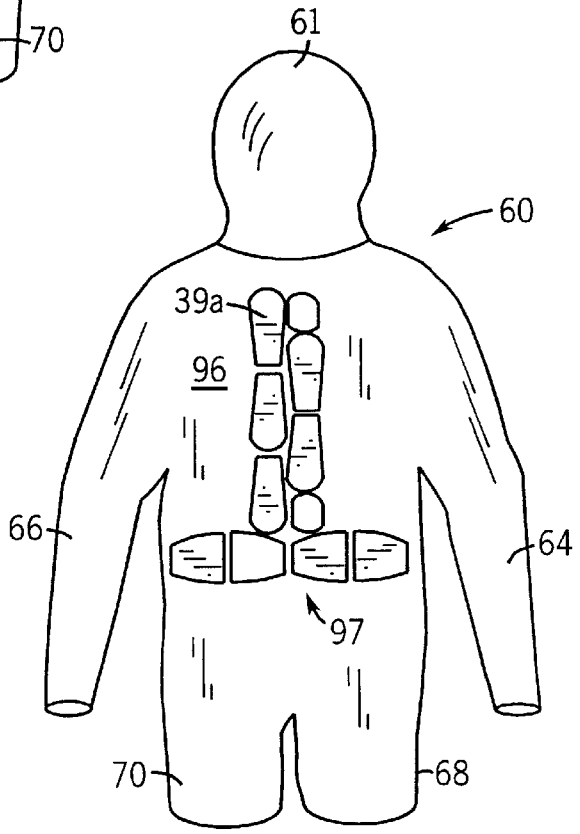
FIG. 12 is a rear elevational view of the third embodiment of the protective suit of the present invention showing the first arrangement of rear plates disposed in the rear portion thereof.

As best seen in FIGS. 11–12, protective suit 60 may include a hood 61 for placing over the head of the wearer of protective suit 60. Hood 61 includes an eye slot 63 therein to allow the wearer of hood 61 to see therethrough. It is contemplated that hood 61 also be constructed from a elastomeric material in order to prevent the body heat of the wearer from escaping, thereby keeping the wearer of hood 61 warm.

Protective suit 60 may be constructed from an elastomeric material for the reasons heretofore described. A plurality of protective plates 39*a* are affixed to the front 74 of protective suit 60 by a flexible adhesive to form front shields 84 and 86. Front shields 84 and 86 are positioned on the front 74 of protective suit 10 so as to substantially overlap the front torso of a wearer of the protective suit 60.

First and second elastomeric covers 80 and 82, respectively, overlap corresponding front shields 84 and 86, respectively, formed by protective plates 39*a*. Outer peripheries 88 and 90 of corresponding inner surfaces 92 and 94, respectively, of covers 80 and 82, respectively, are affixed to the front 74 of protective suit 60 for aesthetic reasons and to capture corresponding front shields 84 and 86 of protective plate 39*a* on protective suit 10.

A plurality of protective plates 39*a* are also mounted to the rear 96 of protective suit 60 by a flexible adhesive so as to form a rear shield 97 which substantially overlaps the kidneys and the spinal column of the wearer. A rear cover 98 includes an inner surface 100 affixed to the rear 96 of protective suit 60 so as to overlap protective plates 39*a*.

As heretofore described, protective plates 39*a* may be constructed of various sizes and shapes in order to maximize the amount of overlap corresponding to various portions of a wearer's body which are susceptible to injury as a result of external trauma, while simultaneously providing a protective suit 10 with sufficient flexibility to allow movement by the wearer thereof.

It is also contemplated, in the alternative, to affix generally circular protective plates 39*b* to the front and rear 74 and 96, respectively, of protective suit 10 to form front shields 84 and 86, and rear shield 97. It is intended that circular protective plates 39*b* maximize the flexibility of the protective suit 10 while simultaneously providing protection against external trauma.

Various mode of carrying out the invention are contemplated as being within the scope of the following claims particularly pointing out and distinctly claiming the subject matter regarded as the invention.

We claim:

1. A protective suit for a snowmobile rider, comprising:

a first inner layer made of a buoyant material;

a second outer layer affixed to the inner layer, the second outer layer being made of a buoyant material;

a set of protective plates provided between the inner and outer layers, the protective plates arranged adjacent to one another to form a flexible protective shield within the suit; and an adhesive disposed between adjacent protective plates for adhering the adjacent protective plates together and for allowing the flexible protective shield to flex.

2. The protective suit of claim 1 wherein the first and second layers are constructed from a heat retaining material.

3. The protective suit of claim 1 wherein one or more of the protective plates of the set of protective plates are generally circular.

4. The protective suit of claim 1 wherein one of the layers includes a thickened portion, the thickened portion constructed from a buoyant material.

5. The protective suit of claim 1 further comprising a second set of protective plates disposed between the inner and the outer layers, each of the protective plates of the second set of protective plates being arranged adjacent one another to form a second flexible protective shield within the suit.

* * * * *